US011445776B2

(12) United States Patent
Welborn

(10) Patent No.: US 11,445,776 B2
(45) Date of Patent: Sep. 20, 2022

(54) RECONFIGURABLE BRIM

(71) Applicant: Lv Welborn, Greenville, SC (US)

(72) Inventor: Lv Welborn, Greenville, SC (US)

( * ) Notice: Subject to any disclaimer, the term of this patent is extended or adjusted under 35 U.S.C. 154(b) by 0 days.

(21) Appl. No.: 17/079,689

(22) Filed: Oct. 26, 2020

(65) Prior Publication Data

US 2022/0125145 A1 Apr. 28, 2022

(51) Int. Cl.
*A42B 1/0183* (2021.01)
*A42B 1/002* (2021.01)

(52) U.S. Cl.
CPC ..... *A42B 1/0183* (2021.01); *A42B 1/002* (2013.01)

(58) Field of Classification Search
CPC ..... A42B 1/004; A42B 1/0182; A42B 1/0183; A42B 1/0184; A42B 1/204; A42B 1/206
See application file for complete search history.

(56) References Cited

U.S. PATENT DOCUMENTS 985,488 A * 2/1911 Wright ..... A42B 1/02 2/209.7
2,115,065 A * 4/1938 Dym ..... B29C 70/228 2/412
2,312,227 A * 2/1943 Yant ..... A42B 3/06 2/412
3,016,545 A * 1/1962 Donahue ..... A42B 1/0182 2/195.5
3,128,474 A * 4/1964 Feldman ..... A42B 1/0182 2/195.6
3,276,038 A 10/1966 Joseph
4,292,689 A * 10/1981 Townsend, Jr. ..... A42B 1/0182 2/12
5,450,629 A * 9/1995 Gilstrap ..... A42B 1/0182 2/209.11
5,581,808 A * 12/1996 Garza ..... A42B 1/206 2/12
5,832,537 A * 11/1998 Wakefield, III ..... A42B 1/0182 2/195.1
5,845,339 A * 12/1998 Ashley ..... A42B 1/0182 2/195.6
6,076,192 A * 6/2000 Kronenberger ..... A42B 1/0182 2/195.6

(Continued)

FOREIGN PATENT DOCUMENTS

DE 102014101549 A1 8/2015

*Primary Examiner* — Heather Mangine
(74) *Attorney, Agent, or Firm* — Argus Intellectual Enterprise; Jordan Sworen; Daniel Enea

(57) ABSTRACT

A reconfigurable brim for a hat. The reconfigurable brim includes a body disposed on a plane. The body includes a hinged core that can selectively deform into a plurality of variable positions, such that in each position a first angle is formed between a first lateral side and a second lateral side of the body, and a second angle is formed between a front section and an opposing rear section of the body. The hinged core can retain each position until selectively reconfigured and allows for repeated reconfiguration without weakening the ability of the hinged core to retain each position. In some embodiments, the hinged core is a matrix embedded into an elastic layer. The hinged core allows the body to be independently and repeatedly repositioned along any point of a lateral axis and longitudinal axis of the plane of the body.

7 Claims, 7 Drawing Sheets

(56) References Cited

U.S. PATENT DOCUMENTS 6,088,837 A * 7/2000 Baker ..... A42B 1/0183 2/195.1
6,138,279 A * 10/2000 Gore ..... A42B 1/0183 2/175.5
6,311,331 B1 * 11/2001 Park ..... A42B 1/0183 2/195.1
6,704,940 B1 3/2004 Convery et al.
7,152,251 B2 * 12/2006 Yan ..... A42B 1/0184 2/195.6
8,402,564 B2 3/2013 Duwyn-Zylstra
8,726,420 B1 * 5/2014 Uitermarkt ..... A42B 1/0182 2/195.6
9,655,396 B1 * 5/2017 Lacy ..... A42B 1/206
10,939,716 B1 * 3/2021 Toro ..... A42B 1/0184
2002/0073478 A1 6/2002 James
2003/0041367 A1 * 3/2003 Hadden ..... D03D 15/593 2/195.5
2003/0074716 A1 * 4/2003 Park ..... A42B 1/0183 2/175.1
2003/0079274 A1 * 5/2003 Noble ..... A42B 1/0185 2/175.5
2003/0084499 A1 * 5/2003 Park ..... A42B 1/0182 2/195.6
2003/0106135 A1 * 6/2003 Landers ..... A42C 1/00 2/195.2
2004/0000004 A1 * 1/2004 Wang ..... A42B 1/0183 2/195.1
2004/0123376 A1 * 7/2004 Wang ..... A42B 1/0183 2/171.1
2004/0194192 A1 * 10/2004 Cho ..... A42B 1/0183 2/195.1
2005/0193474 A1 9/2005 Phillip
2005/0223475 A1 * 10/2005 Turner ..... A42B 1/0182 2/209.4
2005/0273906 A1 12/2005 Kim
2006/0048274 A1 * 3/2006 Lee ..... A42C 5/00 2/181
2006/0090244 A1 * 5/2006 Cho ..... A42B 1/0183 2/195.1
2006/0143793 A1 * 7/2006 Liao ..... A61F 9/045 2/195.6
2006/0179543 A1 8/2006 Burmester
2008/0028498 A1 * 2/2008 Beheton ..... A42B 1/0182 2/175.1
2008/0047048 A1 * 2/2008 Kwon ..... A42B 1/0182 2/175.1
2008/0098502 A1 * 5/2008 Tai ..... A42B 1/0183 2/175.1
2008/0110559 A1 * 5/2008 Matsuzaka ..... B29C 53/063 156/252
2010/0071112 A1 * 3/2010 Iwashita ..... B32B 5/08 2/82
2011/0283441 A1 11/2011 Orman
2012/0066814 A1 * 3/2012 Adams ..... A42B 1/0184 2/195.1
2013/0125292 A1 * 5/2013 Weaver ..... A42B 1/0184 2/209.13
2014/0137311 A1 * 5/2014 Sandoval ..... A42B 1/0183 2/181
2014/0304889 A1 * 10/2014 Oh ..... A42B 1/02 2/175.1
2015/0150328 A1 * 6/2015 Knight ..... A42B 1/0182 2/175.1
2015/0327613 A1 * 11/2015 Kay ..... A42B 1/242 2/209.13
2016/0021959 A1 * 1/2016 Song ..... A42B 1/0182 2/195.1
2017/0071278 A1 * 3/2017 Schulz ..... A42B 1/0182
2017/0224040 A1 * 8/2017 Kim ..... A42B 1/0184
2017/0265552 A1 * 9/2017 Lau ..... B29C 43/52
2017/0325532 A1 * 11/2017 Gerpheide ..... F21V 31/00
2018/0042323 A1 * 2/2018 Oh ..... A42B 1/0184
2018/0055124 A1 * 3/2018 Chen ..... A42B 1/004
2018/0206573 A1 * 7/2018 Hall ..... A42B 1/0184
2018/0220728 A1 * 8/2018 McDade ..... A42B 1/0183
2020/0229527 A1 * 7/2020 Henning ..... A42B 1/205
2021/0251326 A1 * 8/2021 Smith, III ..... A42B 1/02
2021/0267296 A1 * 9/2021 Baptista ..... A42B 1/0184

* cited by examiner

RECONFIGURABLE BRIM

BACKGROUND OF THE INVENTION

The present invention relates to hat brims. The present invention more specifically provides a reconfigurable brim for a hat having a hinged core adapted to selectively deform in a plurality of variable positions, wherein the hinged core retains each position until selectively reconfigured to allow for repeated reconfiguration without weakening the ability of the hinged core to retain each position.

There are many reasons to wear a hat having a different styled or angled brim. Many wearers enjoy expressing themselves through a hat with a specifically angled brim. Other wearers choose to wear a specifically styled brim depending on the weather and sun conditions. For example, a traditional baseball hat can be worn in a variety of different styles. If a baseball hat is worn playing in the outfield, the wearer will likely choose to curve the brim down to keep the sun out of the wearer's eyes. If wearing a baseball hat for a casual outing, the wearer may want a straight brim for the specific style it offers or to expose logos on the hat. Some wearers prefer to stylize the brim of their hat by flipping the brim upwards to expose their eyes or to provide unobscured vision. Other wearers may choose to bend the corners of their hat downwards to block their peripheral vision or reflections to provide more focus to the wearer.

After a hat is purchased, some wearers attempt to shape the brim to achieve the desired style. The step of reshaping a brim is time consuming and requires breaking the brim to form a new shape. However, if the wearer accidently misshapes the brim, a crease will permanently be formed in the brim and it will be impossible to entirely remove the crease therefrom. This is due to the material used to form the brim. To reshape a brim, some wearers choose to wear the hat for an extended period of time to achieve a deformed brim. Another method to break the brim is to soak the brim in liquid at an elevated temperature for a period of time or machine wash the hat. However, these methods can cause not only lasting damage to the brim but fade the coloring of the hat as well as destroy other decorative features thereof. Further, the modified shape by the user will unlikely remain in the desired configuration because the brim is biased to return to its initial shape or further deteriorate.

Some wearer's purchase multiple hats to achieve a desired look or function depending on the occasion. However, purchasing a collection of hats is expensive. Furthermore, storing hats having differently shaped brims is cumbersome because they do not allow for easy stacking. It is also risky to store a hat in compact configuration without destroying the brim. Conventional brims cannot be rolled or tucked within the cap of a hat without altering the integrity of the brim. As a result, having multiple hats with differently shaped brims require storage space that prevents crushing the hat in any way.

Therefore, there exists a need for a device that comprises a brim that is reconfigurable to various positions without destroying the structural integrity of the brim or requiring laborious efforts to reshape the brim into a specific position.

In light of the devices disclosed in the known art, it is submitted that the present invention substantially diverges in design elements and methods from the known art and consequently it is clear that there is a need in the art for an improvement for reconfigurable brims. In this regard the instant invention substantially fulfills these needs.

SUMMARY OF THE INVENTION

In view of the foregoing disadvantages inherent in the known types of reconfigurable brims now present in the known art, the present invention provides a new reconfigurable brim wherein the same can be utilized for selectively deforming into a plurality of variable positions without weakening the ability of the brim to retain each position.

In one embodiment of the present invention, the reconfigurable brim comprises a body having a first lateral side, an opposing second lateral side, and a middle section disposed therebetween, wherein the body is disposed on a plane. The body comprises a hinged core adapted to selectively deform in a plurality of variable positions, such that in each position a first angle is formed between the first lateral side and the second lateral side, and a second angle is formed between a front section and an opposing rear section. The hinged core is configured to retain each position until selectively reconfigured and allows for repeated reconfiguration without weakening the ability of the hinged core to retain each position.

It is an objective of the present invention to provide a reconfigurable brim wherein the body can be independently repositioned along any point of a lateral axis and longitudinal axis of the plane of the body to achieve a different distinctive appearance of the brim in each position.

It is an objective of the present invention to provide a reconfigurable brim comprising an exterior edge and an interior edge extending along the first lateral side, the second lateral side, and the middle section, wherein the interior edge is configured to secure to a hat band.

It is another objective of the present invention to provide a reconfigurable brim having a hinged core comprising a matrix embedded into an elastic layer, such that the matrix is entirely covered by the elastic layer and the elastic layer fills a plurality of openings of the matrix, wherein a first outer layer and a second outer layer enclose the hinged core therebetween.

It is yet another objective of the present invention to provide a reconfigurable brim having a hinged core comprising a series of alternating channels, slots and solid sections disposed in a pattern and extending through the first lateral side, the second lateral side, and the middle section allowing the body to twist and rotate about the hinged core.

It is therefore an object of the present invention to provide a new and improved reconfigurable brim for a hat that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for selectively repositioning a brim of a hat into various positions. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1A:
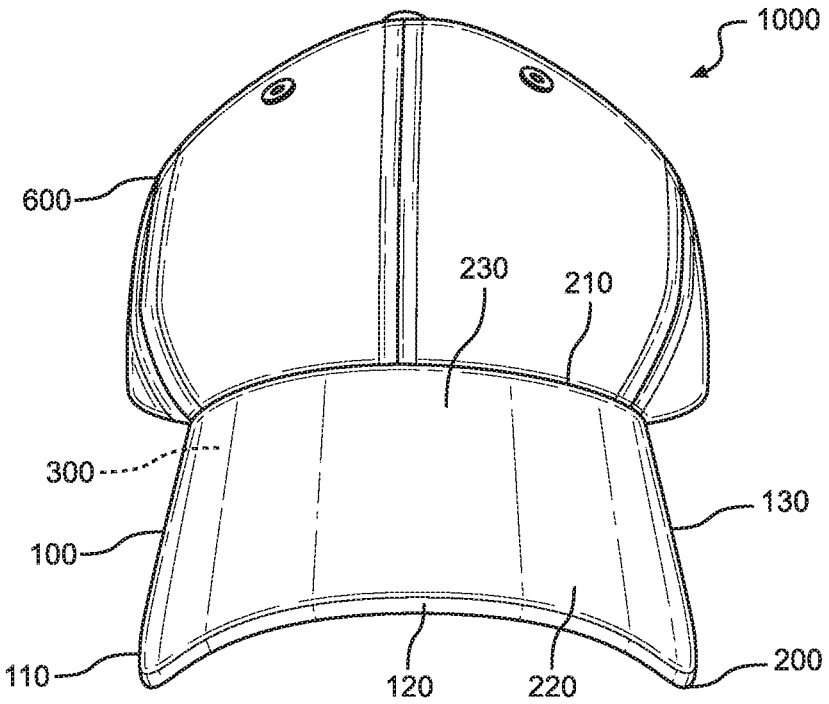
FIG. 1A shows a perspective view of an embodiment of the reconfigurable brim secured to a hat in a first configuration.
Figure 1B:
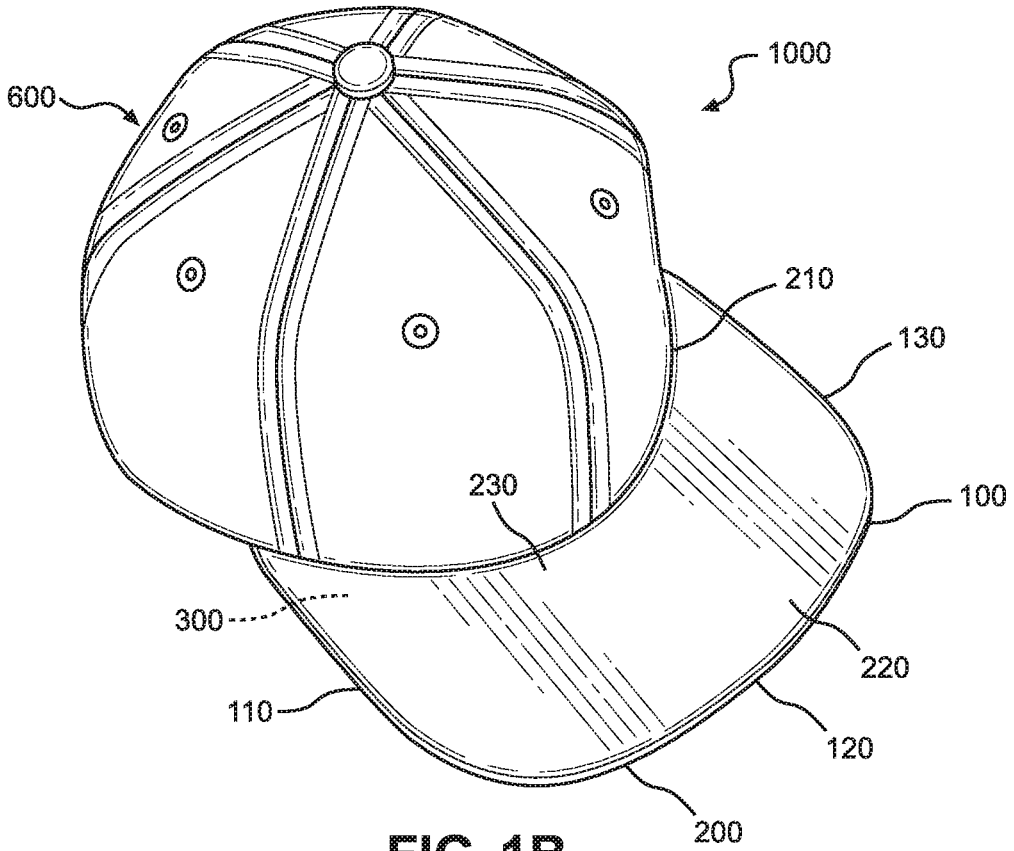
FIG. 1B shows a perspective view of an embodiment of the reconfigurable brim secured to a hat in a second configuration.
Figure 1C:
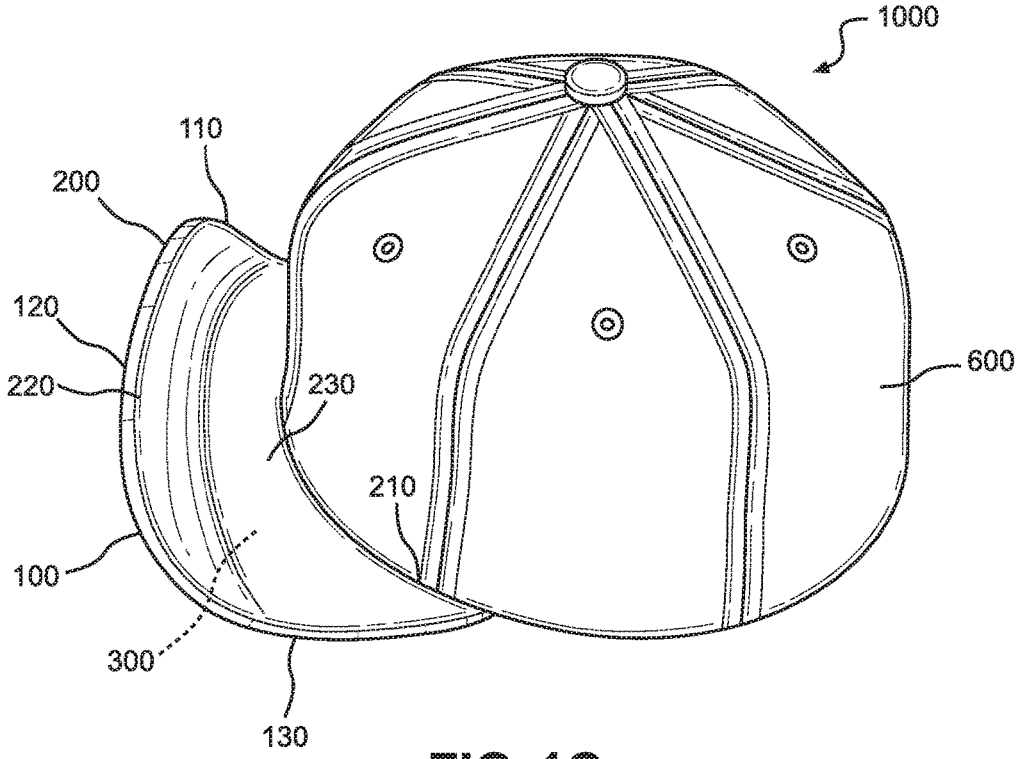
FIG. 1C shows a perspective view of an embodiment of the reconfigurable brim secured to a hat in a third configuration.

Referring now to FIGS. 1A-1C, there are shown perspective views of an embodiment of the reconfigurable brim secured to a hat in various configurations. The reconfigurable brim 1000 is securable to a hat 600 and allows a wearer to reconfigure or deform the brim 1000 in a plurality of variable positions. The brim 1000 comprises a body 100 having a first lateral side 110, an opposing second lateral side 130, and a middle section 120 disposed therebetween. The body 100 is disposed on a plane (as shown in FIG. 1B) and comprises a hinged core 300 adapted to selectively deform such that in each position a first angle is formed between the first lateral side 110 and the second lateral side 130, and a second angle is formed between a front section 220 and an opposing rear section 230.

In the illustrated embodiment, the lateral sides 110, 130 and middle section 120 are separated into equal portions or widths of the body 100, wherein the width is measured between the lateral sides of the body. However, in alternate embodiments, the lateral sides can be larger or smaller than the width of the middle section and the lateral sides can comprise differing widths from each other. The lateral sides 110, 130 and the middle section 120 extend entirely between the front and rear sections 220, 230 of the body 100. In the illustrated embodiment, the front section 220 of the body extends approximately half of the depth thereof, wherein the rear section 230 comprises the other half. In other embodiments, the front section comprises more or less depth than the rear section.

The hinged core 300 is adapted to retain each position until selectively reconfigured and allows for repeated reconfiguration without weakening the ability of the hinged core 300 to retain each position. In the illustrated embodiments, the hinged core 300 occupies a majority of volume within the brim 1000. The hinged core 300 allows the body 100 to be independently repositioned along any point of a lateral axis and longitudinal axis of the plane of the body 100. The plane may be flat or curved. This allows the first angle and second angle to be disposed anywhere along the hinged core 300. Further, the angles can be sharp or formed from a gradual curve allowing for different styled positioning of the brim. For example, one of the angles can have a semi-circular cross section or a V-shaped cross section. In the illustrated embodiment, the angles formed between the lateral sides and middle section can be any angle between 180 degrees to 20 degrees.

The body further comprises an exterior edge 200 and an interior edge 210 extending along the first lateral side 110, the second lateral side 130, and the middle section 120, wherein the interior edge 210 is configured to secure to a hat band or other perimeter area of the hat. The exterior edge 200 is configured to not directly connected to the hat 600.

Figure 2:
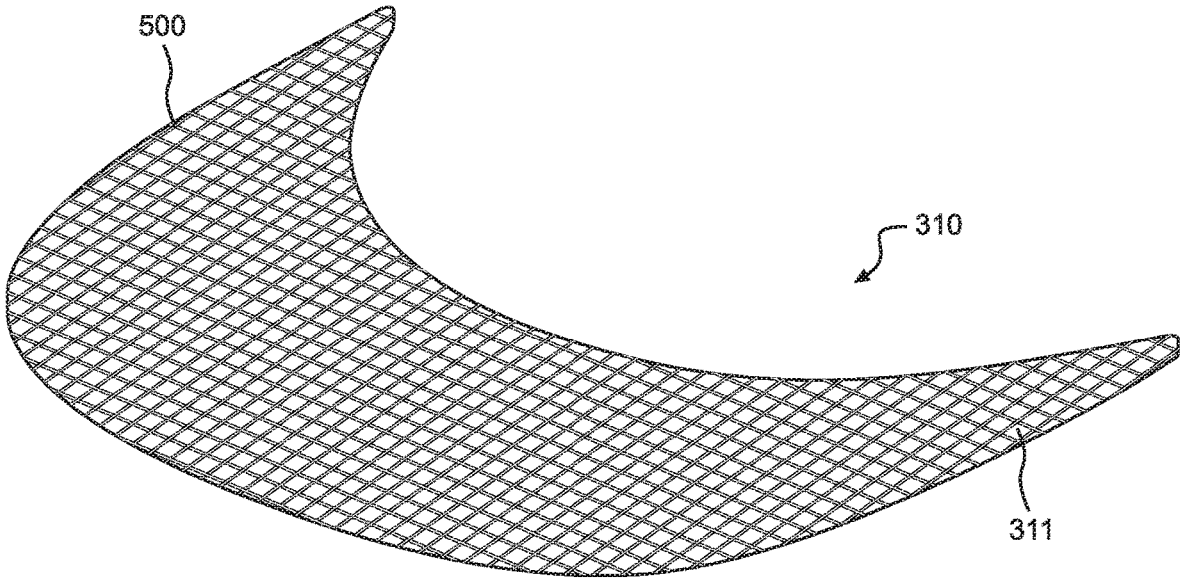
FIG. 2 shows a perspective view of the matrix of an embodiment of the reconfigurable brim.
Figure 3:
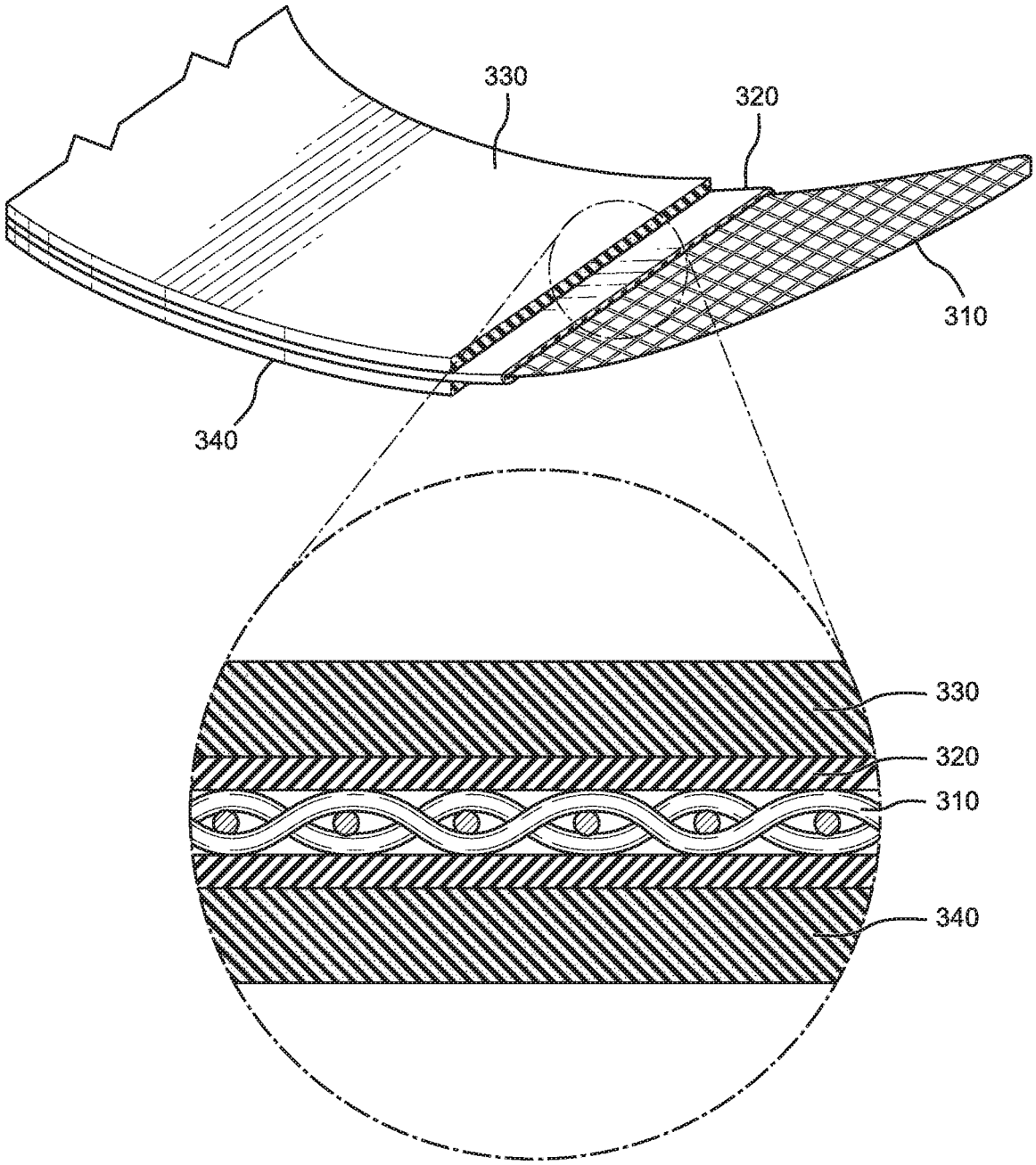
FIG. 3 shows a cross sectional view of a first embodiment of the reconfigurable brim.
Figure 4:
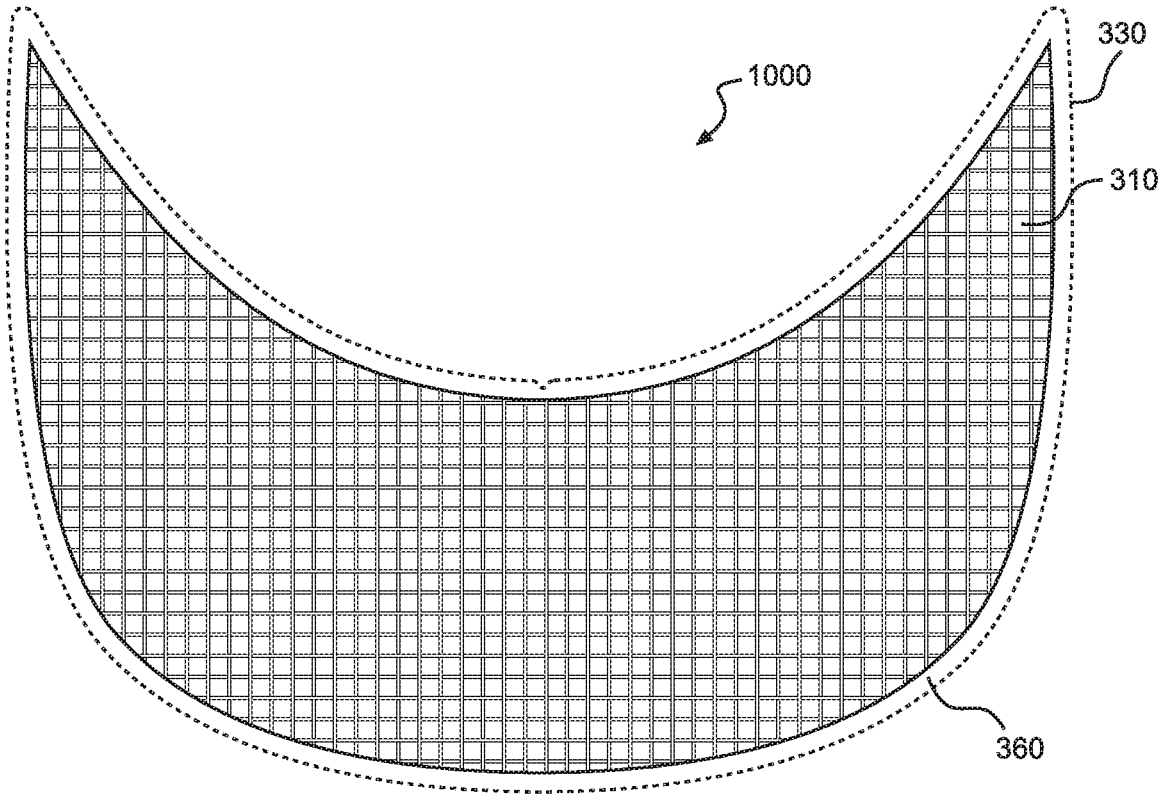
FIG. 4 shows a top planer cutaway view of a body of a first embodiment of the reconfigurable brim.

Referring now to FIGS. 2-4, there is shown a perspective view of the matrix of a first embodiment of the reconfigurable brim, a cross sectional view of a first embodiment of the reconfigurable brim, and a top planer cutaway view of a body of a first embodiment of the reconfigurable brim, respectively. In some embodiments, the hinged core 300 includes a substantially similar perimeter outline as the perimeter outline of the body. In the illustrated embodiment, the hinged core 300 comprises a matrix 310 embedded into an elastic layer 320. In the illustrated embodiment, the matrix 310 is a grid pattern comprising a plurality of openings 311 and composed of a flexible wire that provides for flexibility thereof. The matrix 310 is adapted to twist and bend in any direction. The wire material is configured to allow the matrix 310 to retain its shape once positioned by the wearer. In the illustrated embodiment, the elastic layer 320 entirely covers the matrix 310 and fills every opening of the matrix 310 (the elastic layer is not shown between the openings of the matrix in FIG. 3 for clarity). The elastic layer 320 is configured to cover the edges of the matrix 310 to prevent any corners from being exposed through the brim. In some embodiments, the matrix 310 is molded into the elastic layer 320, wherein the elastic layer is rubber urethane having a hardness of 85 A. However, in alternate embodiments, the elastic layer is any suitable material configured to deform along with the matrix. In some embodiments, the elastic layer is not disposed between the openings of the matrix and only positioned above and below the matrix.

In the illustrated embodiment, the reconfigurable brim 1000 comprises a first outer layer 330 and a second outer layer 340 sandwiching the hinged core 300 therebetween. In some embodiments, the outer layers 330, 340 are composed of fabric and form the exterior of the brim 1000. In some embodiments wherein the brim is secured to the hat, the interior edge of the outer layers 330, 340 of the body 100 is secured to the hat via sewing, adhesive or other suitable fastener. In the illustrated embodiment, the hinged core 300 comprises a same shaped perimeter outline as a perimeter outline of the first outer layer 330 and second outer layer 340. In other embodiments, a cushioned layer is positioned between each of the outer layers and the hinged core to provide for extra comfort to the wearer when handling or manipulating the brim 1000.

In the illustrated embodiment, the hinged core 300 comprises a slightly smaller length and width than the first and second outer layers 330, 340, wherein a notch is positioned along the interior edge 210 of the middle section 120 of each of the outer layers and configured to abut the hinged core 300. The depth of the notch is equivalent to the distance or gap 360 between the perimeter of the hinged core 300 and the perimeter of the outer layers 330, 340.

Figure 5A:
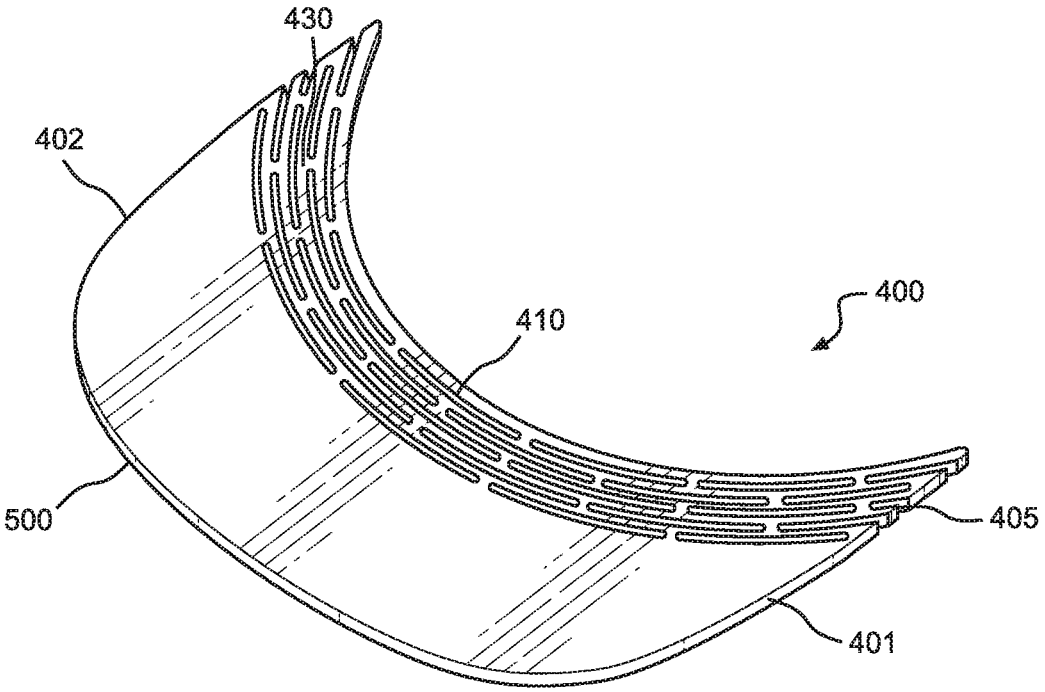
FIG. 5A shows a perspective view of the body of a second embodiment of the reconfigurable brim in a planar position.
Figure 5B:
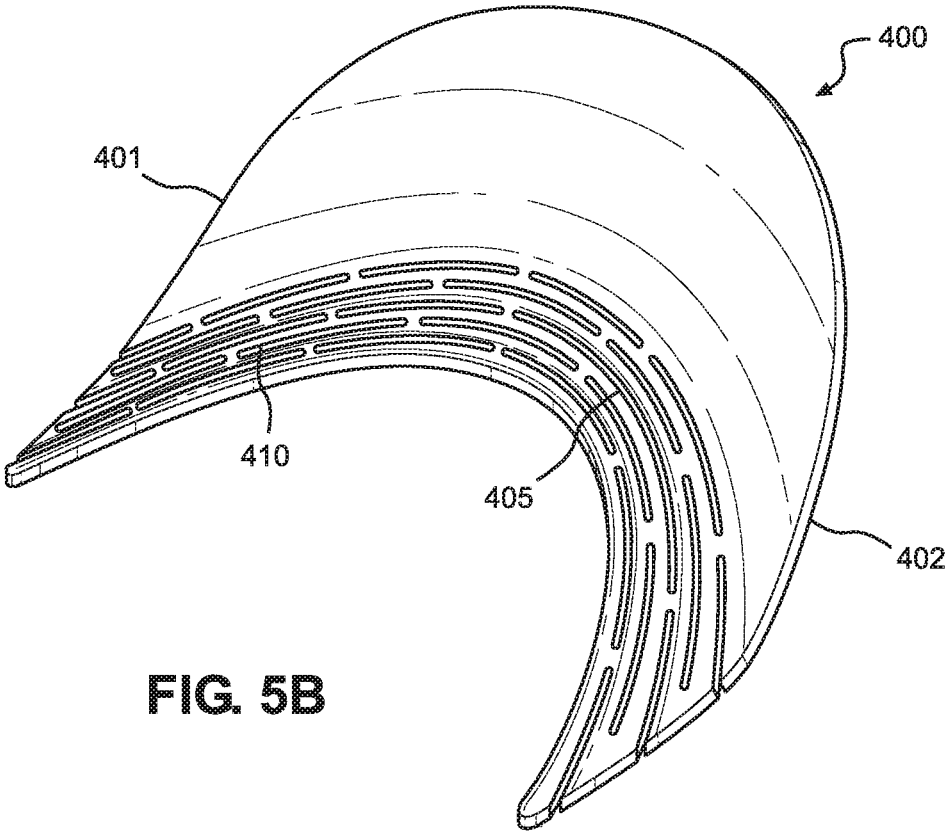
FIG. 5B shows a perspective view of the body of a second embodiment of the reconfigurable brim in a bent position.

Referring now to FIGS. 5A and 5B, there is shown a perspective view of the body of a second embodiment of the reconfigurable brim in a planar position and a perspective view of the body of a second embodiment of the reconfigurable brim in a bent position, respectively. In the illustrated embodiment, instead of a matrix and elastic layer, the hinged core 405 comprises a series of channels 410 disposed in a plurality of rows, wherein each adjacent row the channels 410 are offset from one another. The area between the channels are formed of solid sections 430 of the body. The channels 410 extend through the first lateral side, the second lateral side, and the middle section allowing the body to twist and rotate about the hinged core. The pattern of the channels, the plurality of rows of channels, and the length of each channel provide the flexibility of the hinged core. In this way, the amount of hinged core 405 that is needed to bend to form the desired shape is greatly reduced, as only the hinged core 405 material between the plurality of channels and rows of channels are angled.

The solid sections 430 are interconnected and extend from the rear section of the body to the front section thereof. In the illustrated embodiment, each channel 410 comprises a same length. However, in alternate embodiments, the channels have differing lengths depending on the position thereof. In the illustrated embodiment, the hinged core 405 follows a curvature similar to the curvature of the interior edge of the body and disposed at the rear section thereof.

Figure 6:
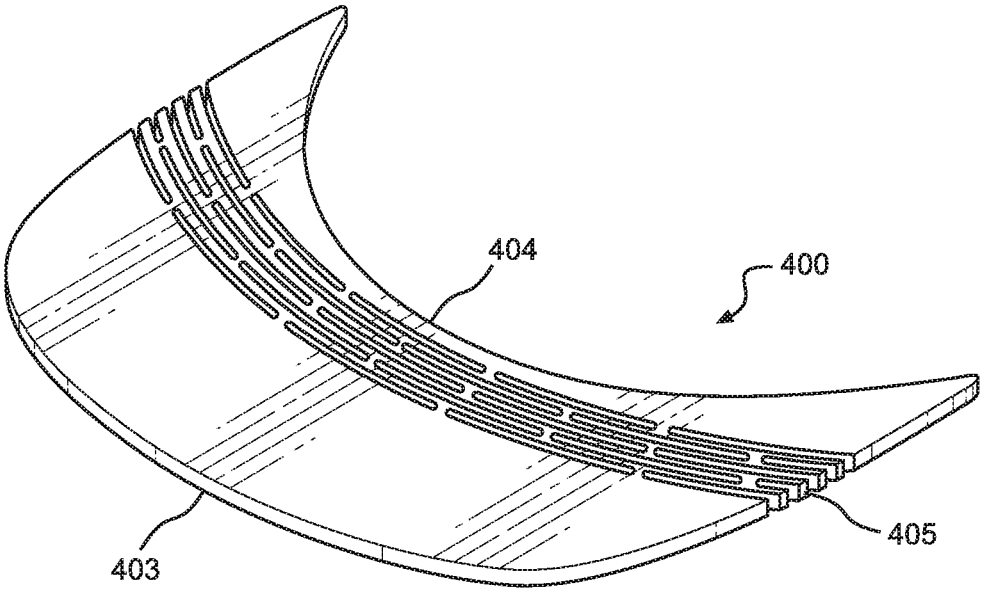
FIG. 6 shows a perspective view of the body of a third embodiment of the reconfigurable brim in a planar position.
Figure 7:
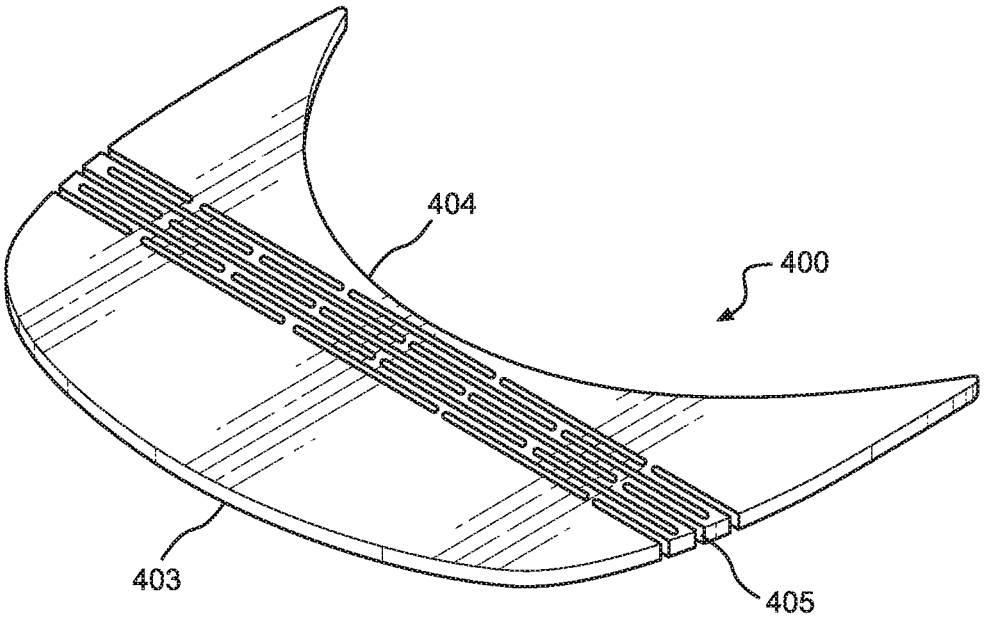
FIG. 7 shows a perspective view of the body of a fourth embodiment of the reconfigurable brim in a planar position.

In alternate embodiments, the hinged core 405 is linearly disposed between the first and second lateral sides 401, 402 the body 400 as seen in FIG. 7. In other embodiments, the entire body 400 comprises the hinged core therethrough. In some embodiments, the hinged core 405 is disposed between the front and rear sections 403, 404 of the body, wherein the hinged core 405 does not abut the interior edge or exterior edge, as seen in FIG. 6. In other embodiments, the hinged core 405 is disposed centrally between the front and rear sections 403, 404 of the body 400.

In some embodiments, the brim comprises a wire rim 500 disposed around the edges of the body. The wire rim 500 is configured to bend and contort with the hinged core 405, thereby retaining the selected position of the brim. The brim retains the desired position until the wearer applies force to the brim, thereby adjusting the angles of the hinged core. In an alternate embodiment, instead of the wire rim, the body comprises a pliable layer overlaying the hinged core and solid areas extending therearound. In some embodiments, the pliable layer is the matrix as shown in FIG. 2. In alternate embodiments, the pliable layer is a sheet of metal having a same perimeter outline as the body or the matrix. The pliable layer is configured to retain the position of the brim until the wearer applies force thereto, similarly to the wire rim embodiment. The pliable layer comprises a same perimeter outline as the perimeter outline of the body.

Figure 8:
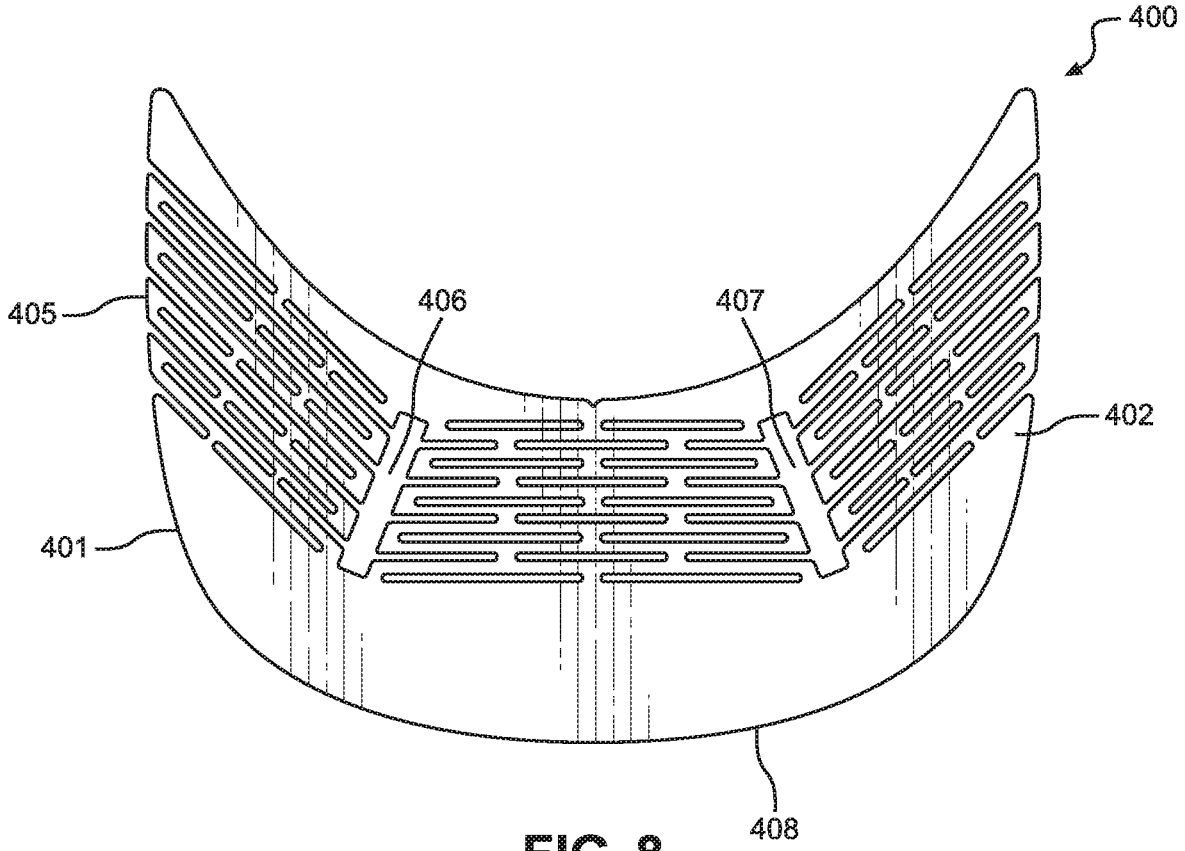
FIG. 8 shows a top planar view of the body of a fifth embodiment of the reconfigurable brim.

Referring now to FIG. 8, there is shown a top planar view of the body of a fifth embodiment of the reconfigurable brim. In the illustrated embodiment, the hinged core 405 comprises a first opening 406 between the first lateral side 401 and the middle section 408 and a second opening 407 between the middle section 408 and the second lateral side 402. The openings 406, 407 allow for sharper first and second angles formed therebetween. In the illustrated embodiment, the openings 406, 407 extend the entire length of the hinged core 405, wherein the length is measured between the front and rear sections of the body. The channels adjacent to the openings extend therefrom.

Figure 9:
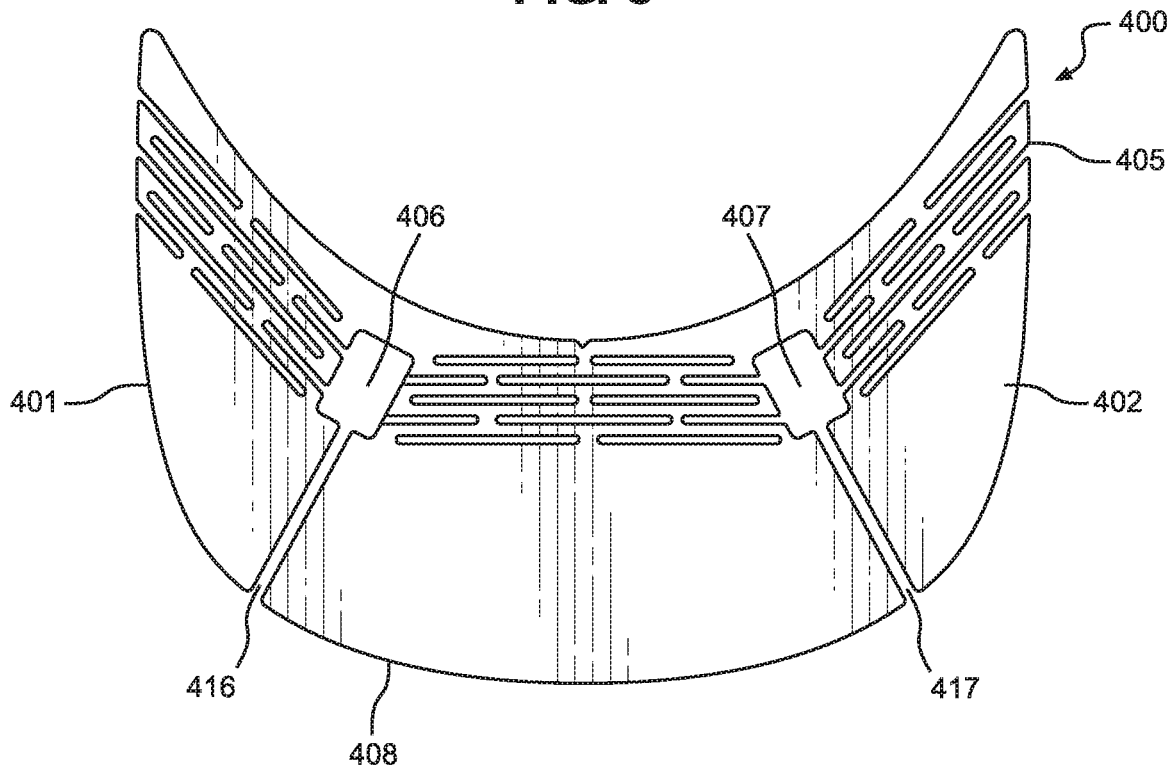
FIG. 9 shows a top planar view of the body of a sixth embodiment of the reconfigurable brim.

Referring now to FIG. 9, there is shown a top planar view of the body of a sixth embodiment of the reconfigurable brim. In other embodiments, a slot 416, 417 extends from each of the first opening 406 and the second opening 407 and terminates at an exterior edge of the body 400. The slots 416, 417 provide additional flexibility to the body to allow greater movement between the first lateral side, the second lateral side, and the middle section. Moreover, the slots 416, 417 provide for independent configurations of each portion of the hinged core 405. In the shown embodiment, the hinged core 405 is sectioned into three portions, a left, middle, and right by the pair of slots 416, 417. In alternative embodiments, the hinged core 405 comprises one or more slots that provides for a plurality of independent portions.

In operation, the brim is disposed in a first configuration, such as laying entirely flat on the plane of the body, as seen in FIG. 1B. A wearer manipulates the brim to desired second configuration, such as curling the front section of the brim above the plane, wherein the rear section still remains on the plane, as seen in FIG. 1C. In some configurations, the front section is curled or bent toward the rear section, wherein a portion of the front section of the brim is parallel with the plane. The brim is adapted to be immediately reconfigured to the first configuration or to a third configuration. In the third configuration, the brim is curved downwards such that the first and second lateral sides are below the plane and the middle section remains on the plane, as seen in FIG. 1A.

The wearer can then reconfigure the brim back to either the first or second configurations or deform the brim into a fourth configuration. There are a multitude of configurations in which the brim can be reconfigured. Further, the brim retains each configuration without the additional of any fasteners external the brim. In some known art, brim positions can be retained through the use of a fastener located on the exterior of the brim or hat. The present invention does not require the use of any fasteners. The structure of body, which includes the hinged core, disposed within the brim allows the brim to retain any configuration capable of the hinged core. Further, the hinged core is intended to be bent and twisted so as to not weaken the ability of the hinged core to retain each position, allowing the body to be independently and repeatedly repositioned along any point along the hinged core.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reconfigurable brim of a hat, comprising:

a body having a hinged core adapted to selectively deform in a plurality of variable positions;

wherein the hinged core retains each position until selectively reconfigured and allows for repeated reconfiguration without weakening the ability of the hinged core to retain each position;

wherein the hinged core comprises a matrix embedded into an elastic layer, such that the matrix is entirely covered by the elastic layer and the elastic layer fills a plurality of openings of the matrix;

wherein the matrix is adapted to twist and bend in any direction;

wherein the elastic layer covers all of an outermost edge of an entire perimeter of the matrix, wherein the outermost edge is disposed between an upper side of the elastic layer and a lower side of the elastic layer;

the body further comprising a first outer layer and a second outer layer sandwiching the hinged core therebetween; and further comprising the hat on which the body extends therefrom.

2. The reconfigurable brim of claim 1, wherein the body is disposed on a plane extending outward from the hat, the plane being flat or curved, wherein the body is configured to be repositioned along any point of a lateral axis and longitudinal axis of the plane thereof.

3. The reconfigurable brim of claim 1, the body further comprising an exterior edge and an interior edge extending along a first lateral side, a second lateral side, and a middle section, wherein the interior edge is configured to secure to a hat band.

4. The reconfigurable brim of claim 3, wherein the first outer layer and second outer layer each comprise a notch positioned along the interior edge of the middle section configured to abut the hinged core.

5. The reconfigurable brim of claim 1, wherein the hinged core comprises a same shaped perimeter outline as a perimeter outline of the first outer layer and second outer layer.

6. The reconfigurable brim of claim 5, wherein the hinged core comprises a smaller length and width than the first outer layer and the second outer layer.

7. The reconfigurable brim of claim 1, wherein the hinged core comprises a same perimeter outline as a perimeter outline of the body.

* * * * *